US006700107B2

(12) United States Patent
Lee

(10) Patent No.: US 6,700,107 B2
(45) Date of Patent: Mar. 2, 2004

(54) WALL-MOUNTED TYPE MICROWAVE OVEN

(75) Inventor: Se-Hun Lee, Incheon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/225,173

(22) Filed: Aug. 22, 2002

(65) Prior Publication Data

US 2003/0226842 A1 Dec. 11, 2003

(30) Foreign Application Priority Data

Jun. 8, 2002 (KR) ..... 2002-32163

(51) Int. Cl.[7] ..... H05B 6/80
(52) U.S. Cl. ..... 219/757; 219/758; 126/273 A
(58) Field of Search ..... 219/757, 758, 219/681, 756, 391, 400, 220; 126/213, 273 A, 21 A, 299 D, 299 R, 21 R; 362/92, 133, 125–126; 312/236

(56) References Cited

U.S. PATENT DOCUMENTS 4,254,450 A * 3/1981 White et al. ..... 362/92
4,476,362 A * 10/1984 Kusunoki et al. ..... 219/748
5,747,783 A * 5/1998 Myung et al. ..... 219/758
6,201,225 B1 * 3/2001 Lee ..... 219/757
6,528,772 B1 * 3/2003 Graves et al. ..... 219/680

FOREIGN PATENT DOCUMENTS

JP 2000-002434 1/2000

* cited by examiner

*Primary Examiner*—Quang T. Van
(74) *Attorney, Agent, or Firm*—Staas & Halsey

(57) ABSTRACT

A wall-mounted type microwave oven includes an oven body and a single lighting device which illuminates a cooking chamber of the oven body and a kitchen space below the oven body. The lighting device is provided at a lower portion of the oven body to illuminate the cooking chamber and the kitchen space. The cooking chamber includes an upper opening formed at its bottom plate to allow light emitted from the lighting device to pass into the cooking chamber therethrough, and the oven body includes a lower opening formed at its bottom plate to allow the light to pass to the kitchen space.

19 Claims, 4 Drawing Sheets

WALL-MOUNTED TYPE MICROWAVE OVEN

CROSS-REFERENCE TO RELATED APPLICATIONS

This application claims the benefit of Korean Patent Application No. 2002-32163 filed on Jun. 8, 2002, in the Korean Industrial Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a lighting device which illuminates the inside of a cooking chamber and a kitchen space below an oven body of the microwave oven.

2. Description of the Related Art

FIG. 1 shows a conventional wall-mounted type microwave oven 3. Generally, the wall-mounted type microwave oven 3 is installed on a wall 2 over an oven range 1, and carries out an exhausting operation to exhaust gas and fumes generated from the oven range 1 to the outside, as well as a cooking operation to cook food using electromagnetic waves.

The wall-mounted type microwave oven 3 is provided at its top with an upper lighting device 5 which illuminates a cooking chamber 4 to enable a user to observe the inside of the cooking chamber 4. Furthermore, the wall-mounted type microwave oven 3 is provided at its bottom with a lower lighting device 6 which illuminates a kitchen space below the wall-mounted type microwave oven 3. Generally, the upper lighting device 5 is automatically turned on when a user carries out a cooking activity, while the lower lighting device 6 is turned on when a lighting button provided on a control panel (not shown) of the wall-mounted type microwave oven 3 is pressed.

However, since the above-described wall-mounted type microwave oven 3 requires an upper lighting device 5 to illuminate the cooking chamber 4 and a separate lower lighting device 6 to illuminate the kitchen space below the wall-mounted type microwave oven 3, productivity of the wall-mounted type microwave oven 3 is decreased and the manufacturing cost is increased due to an increased number of components.

SUMMARY OF THE INVENTION

Accordingly, it is an object of the present invention to provide a wall-mounted type microwave oven which is adapted to illuminate a cooking chamber and a kitchen space below an oven body, simultaneously, by using a single lighting device.

Additional objects and advantages of the invention will be set forth in part in the description which follows and, in part, will be obvious from the description, or may be learned by practice of the invention.

To achieve the above and other objects of the present invention, there is provided a wall-mounted type microwave oven comprising an oven body which defines an outer appearance of the microwave oven, and includes a cooking chamber, an exhaust system provided in the oven body to exhaust gas and fumes in a kitchen space below the oven body, and a lighting device which is provided at a lower portion of the oven body and generates light to illuminate the cooking chamber and the kitchen space, wherein the cooking chamber includes an upper opening which is formed at a bottom plate of the cooking chamber and allows the light emitted from the lighting device to pass into the cooking chamber therethrough, and the oven body includes a lower opening which is formed at a bottom plate of the oven body and allows the light emitted from the lighting device to pass to the kitchen space therethrough.

The lighting device may be provided in a space defined between the bottom plate of the cooking chamber and the bottom plate of the oven body.

The lighting device may include a housing having an upper opened end attached to the bottom plate of the cooking chamber and a lower opened end attached to the bottom plate of the oven body, wherein the upper and lower opened ends correspond to the upper and lower openings.

The upper and lower openings may be provided with corresponding transparent cover plates to prevent foreign substances from entering into the interior of the housing.

The upper opening may be equipped with a porous shield plate, which allows the light emitted from the lighting device to pass therethrough while preventing high-frequency electromagnetic waves from passing therethrough.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
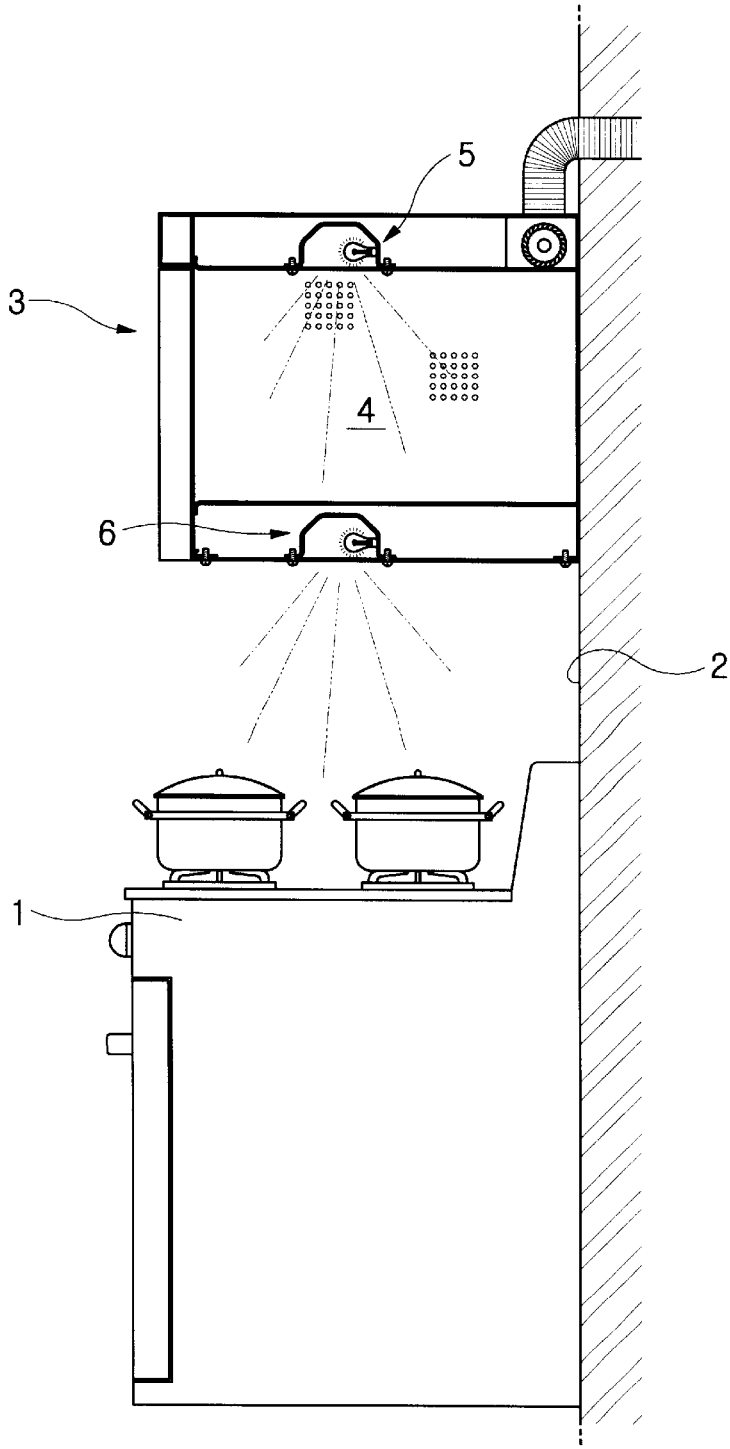
FIG. 1 (PRIOR ART)
FIG. 1 is a side cross-sectional view of a conventional wall-mounted type microwave oven, which is mounted on a wall above an oven range.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
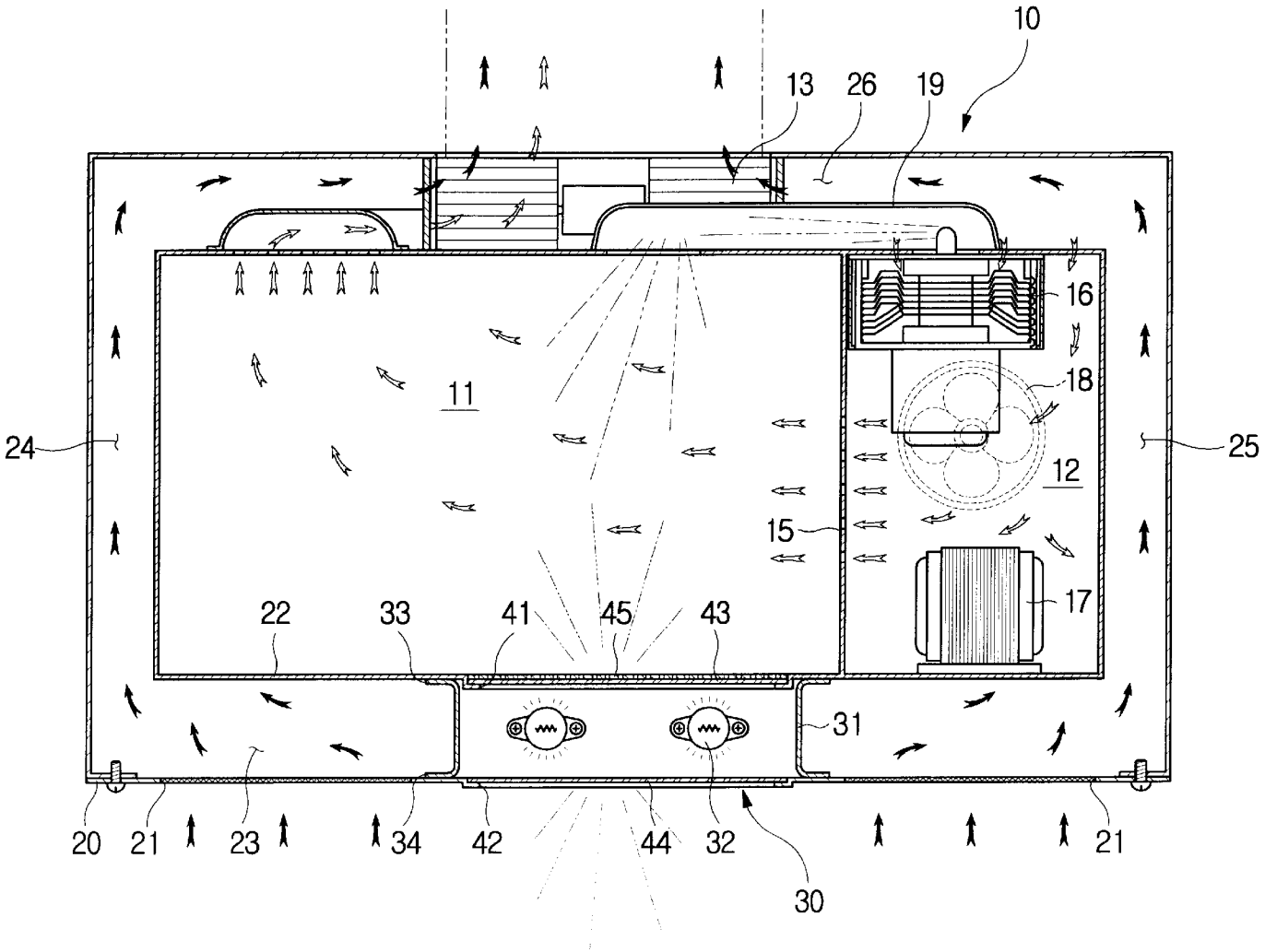
FIG. 2 is a cross-sectional view of a wall-mounted type microwave oven according to an embodiment of the present invention.
Figure 3:
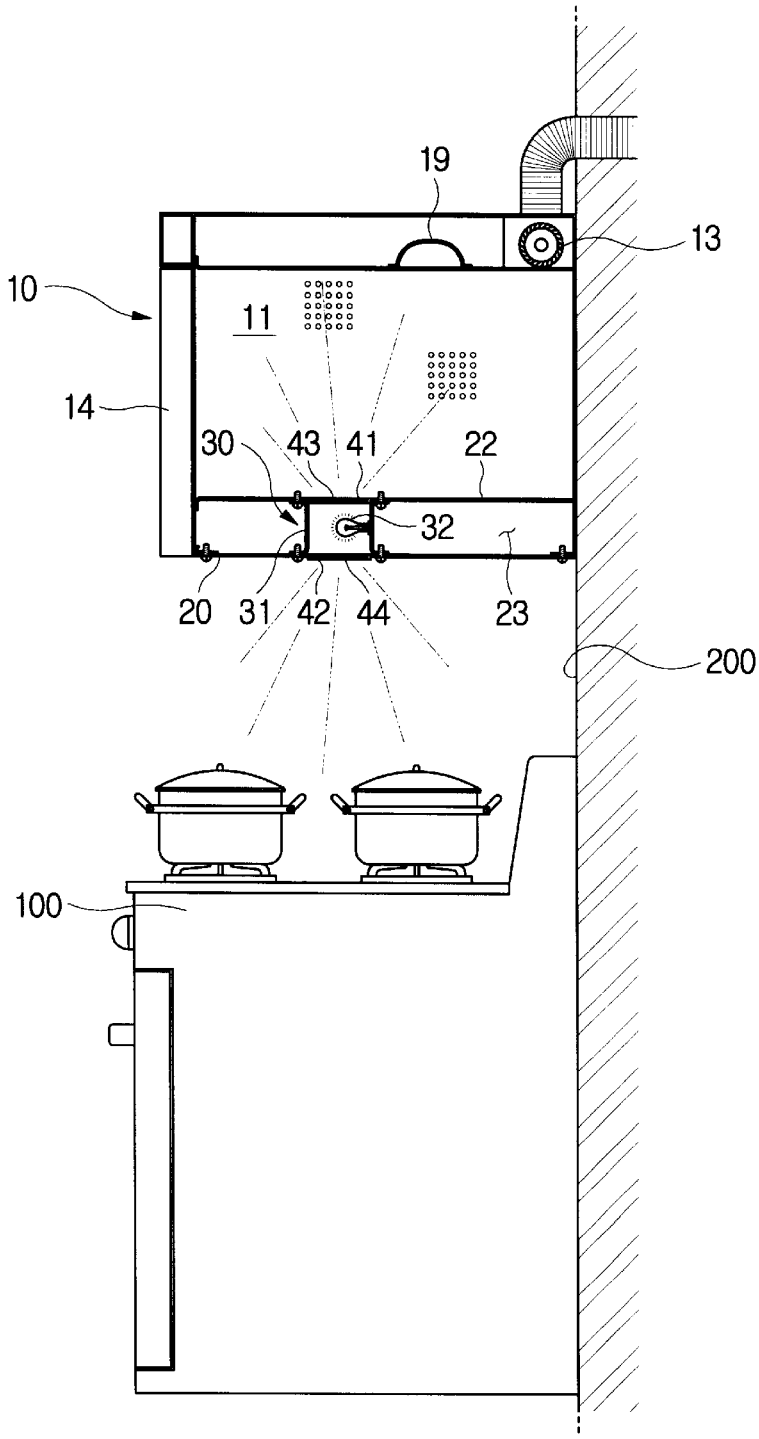
FIG. 3 is a side cross-sectional view of the wall-mounted type microwave oven shown in FIG. 2 mounted on a wall above an oven range.

FIGS. 2 and 3 show a wall-mounted type microwave oven according to an embodiment of the present invention. A body 10 of the wall-mounted type microwave oven is mounted on, for example, a kitchen wall over an oven range 100. The oven body 10 includes a cooking chamber 11 to cook food therein, and an electrical component compartment 12 which is isolated from the cooking chamber 11. The oven body 10 further includes an exhaust path (shown by dark arrows) to exhaust gas and fumes generated from the oven range 100. The exhaust path is isolated from the cooking chamber 11 and the electrical component compartment 12. An exhaust fan 13 is provided at a rear upper portion of the oven body 10, and discharges the gas and fumes guided through the exhaust path. A door 14 is provided at a front face of the cooking chamber 11 to place and remove the food from the cooking chamber 11.

The electrical component compartment 12 is isolated from the cooking chamber 11 by a partition plate 15. The electrical component compartment 12 includes a magnetron 16 which generates high-frequency electromagnetic waves, a high voltage transformer 17 which applies a high voltage to the magnetron 16, and a cooling fan 18 which cools electric components, such as the magnetron 16 and the high voltage transformer 17, equipped in the electrical component compartment 12.

The magnetron 16 is disposed at an upper portion of the electrical component compartment 12, and the high voltage transformer 17 is placed on a bottom of the electrical component compartment 12. A waveguide 19 is provided to the cooking chamber 11 and the electrical component compartment 12, and serves to guide the high-frequency electromagnetic waves generated from the magnetron 16 to the cooking chamber 11. Though not shown in the drawings, the electrical component compartment 12 is equipped at its front face with a control panel including a plurality of control buttons which control various functions of the microwave oven and a display which indicates an operational condition of the microwave oven.

The exhaust path is adapted to exhaust gas and fumes generated from the oven range 100 disposed below the oven body 10. The exhaust path includes an intake port 21 formed at a bottom plate 20 of the oven body 10, a lower flow path 23 defined between bottom surfaces of the cooking chamber 11 and the electric component compartment 12, and the bottom plate 20 of the oven body 10, a pair of rising flow paths 24 and 25 which are disposed at corresponding sides of the cooking chamber 11 and the electric component compartment 12 to extend up and down, and an upper flow path 26 which is disposed on an upper portion of the oven body 10 to guide the gas and fumes introduced through the pair of rising flow paths 24 and 25 toward the exhaust fan 13. Accordingly, by rotation of the exhaust fan 13, the gas and fumes sucked through the intake port 21 of the bottom plate 20 are exhausted to the outside through the lower flow path 23, the rising flow paths 24 and 25, and the upper flow path 26.

The wall-mounted type microwave oven according to the present invention is further provided with a lighting device 30 which concurrently illuminates the inside of the cooking chamber 11 and a kitchen space below the microwave oven.

Figure 4:
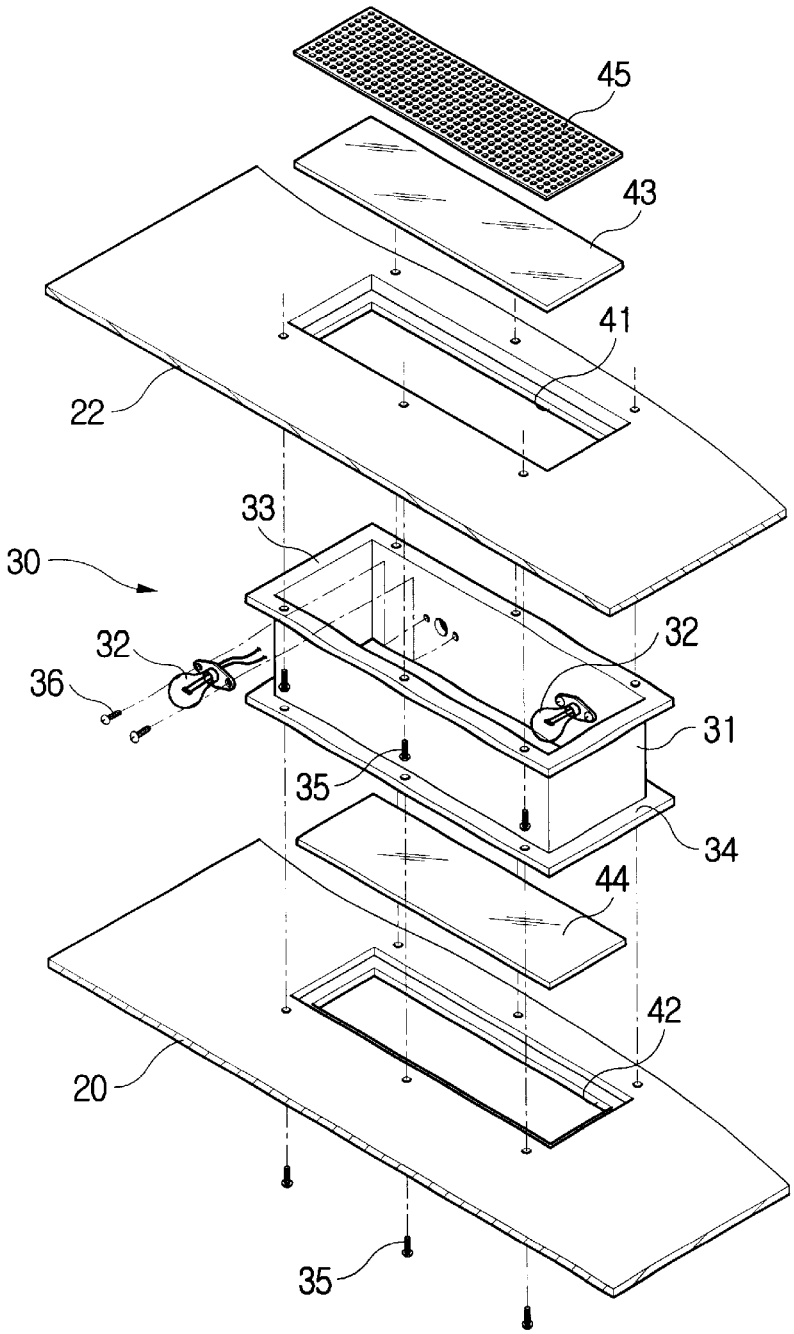
FIG. 4 is an exploded perspective view of a lighting device incorporated in the wall-mounted type microwave oven shown in FIG. 2.

FIG. 4 shows an exploded perspective view of the lighting device 30. The lighting device 30 comprises a housing 31 disposed in a space defined between a bottom plate 22 of the cooking chamber 11 and a bottom plate 20 of the oven body 10, and lamps 32 disposed in the housing 31. The housing 31 is shaped as a hexahedral box having front and rear side faces and left and right side faces, with upper and lower faces being opened. The lamps 32 are fixed to the rear side face of the housing 31 by fastening screws 36. The housing 31 is provided with its upper and lower faces with upper and lower flanges 33 and 34, respectively, so as to fix the housing 31 to the bottom plate 22 of the cooking chamber 11 and the bottom plate 20 of the oven body 10. More specifically, the upper and lower flanges 33 and 34 are fixedly attached to the bottom plate 22 of the cooking chamber 11 and the bottom plate 20 of the oven body 10 by fastening screws 35.

The bottom plate 22 of the cooking chamber 11 is formed with an upper opening 41 at a position corresponding to that of the opened upper face of the housing 31, so as to have light emitted from the lamps 32 of the lighting device 30 pass into the inside of the cooking chamber 11. Likewise, the bottom plate 20 of the oven body 10 is formed with a lower opening 42 at a position corresponding to that of the opened lower face of the housing 31, so as to have the light emitted from the lamps 32 pass toward the kitchen space below the oven body 10.

The lighting device 30 is designed so as to have the lamps 32 disposed in the housing 31 to be protected by the housing 31. The light from the lamps 32 is reflected via inner faces of the housing 31 and simultaneously directed toward the inside of the cooking chamber 11 and the kitchen space below the oven body 10 through the corresponding upper and lower openings 41 and 42.

The upper opening 41 formed at the bottom plate 22 of the cooking chamber 11 is equipped with a porous shield plate 45. The porous shield plate 45 allows the light emitted from the lamps 32 to pass therethrough while preventing high-frequency electromagnetic waves in the cooking chamber 11 from leaking outward through the upper opening 41. In addition, the upper and lower openings 41 and 42 are provided with transparent cover plates 43 and 44, respectively, to prevent foreign substances from entering into the interior of the housing 31. The porous shield plate 45 and the cover plates 43 and 44 are applied with an adhesive at their peripheral edges to maintain the housing 31 in an airtight state.

In a lighting operation, the lighting device 30 may be automatically turned on at the time of a cooking operation of the microwave oven. In addition, the control panel of the microwave oven may be provided with an additional lighting button to allow a user to selectively turn on the lighting device, so as to illuminate the kitchen space below the oven body 10 where the microwave oven is not operated to cook food therein.

As described above, the present invention provides a wall-mounted type microwave oven having a lighting device which can simultaneously illuminate the inside of a cooking chamber and a kitchen space below the microwave oven. Consequently, the wall-mounted type microwave oven according to the present invention has a simplified structure, and the number of components used in the microwave oven can be reduced. Therefore, as compared to a conventional wall-mounted type microwave oven, the manufacturing cost for the present microwave oven is reduced and the productivity is increased.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven comprising:

an oven body which defines an outer appearance of the microwave oven, and includes a cooking chamber;

an exhaust system provided in the oven body to exhaust gas and fumes in a kitchen space below the oven body; and a lighting device which is provided at a lower portion of the oven body, and generates light to illuminate the cooking chamber and the kitchen space, wherein:

the cooking chamber includes an upper opening which is formed at a bottom plate of the cooking chamber, and allows the light emitted from the lighting device to pass into the cooking chamber therethrough, and the oven body includes a lower opening which is formed at a bottom plate of the oven body, and allows the light emitted from the lighting device to pass to the kitchen space therethrough.

2. The wall-mounted type microwave oven as set forth in claim 1, wherein the lighting device is provided in a space defined between the bottom plate of the cooking chamber and the bottom plate of the oven body.

3. The wall-mounted type microwave oven as set forth in claim 2, wherein the lighting device includes a housing having an upper opened end attached to the bottom plate of the cooking chamber and a lower opened end attached to the bottom plate of the oven body, wherein the upper and lower opened ends correspond to the upper and lower openings.

4. The wall-mounted type microwave oven as set forth in claim 1, wherein the upper and lower openings are provided with corresponding transparent cover plates, which prevent foreign substances from entering into the housing.

5. The wall-mounted type microwave oven as set forth in claim 1, wherein the upper opening is equipped with a porous shield plate, which allows the light emitted from the lighting device to pass therethrough while preventing high-frequency electromagnetic waves from passing therethrough.

6. The wall-mounted type microwave oven as set forth in claim 1, further comprising:

a magnetron which generates high-frequency electromagnetic waves;

a high voltage transformer which applies a voltage to the magnetron; and a waveguide which guides the high-frequency electromagnetic waves generated from the magnetron to the cooking chamber.

7. The wall-mounted type microwave oven as set forth in claim 1, wherein the lighting device simultaneously illuminates the cooking chamber and the kitchen space.

8. The wall-mounted type microwave oven as set forth in claim 1, wherein the lighting device emits the light in response to one of a cooking operation of the microwave oven and an on-signal input by a user.

9. The wall-mounted type microwave oven as set forth in claim 1, wherein the exhaust system comprises:

an exhaust path provided in the oven body;

an intake port which introduces the gas and fumes into the exhaust path; and an exhaust fan which communicates with the exhaust path and discharges the gas and fumes to a desired direction.

10. A wall-mountable cooking apparatus comprising:

an oven body which defines an outer appearance of the cooking apparatus, and includes a cooking chamber to receive food therein;

a heating unit which cooks the food;

a lighting device which is provided at a lower portion of the oven body, to concurrently and directly illuminate the cooking chamber and a kitchen space below the oven body.

11. The wall-mountable cooking apparatus as set forth in claim 10, wherein:

the cooking chamber includes an upper opening which is formed at a bottom plate of the cooking chamber, and allows the light emitted from the lighting device to illuminate the cooking chamber, and the lower opening which is formed at the bottom plate of the oven body, allows the light to illuminate the kitchen space.

12. The wall-mountable cooking apparatus as set forth in claim 11, wherein the lighting device comprises:

a housing having an upper opened end attached to the upper opening of the cooking chamber and a lower opened end attached to the lower opening of the oven body; and a light source which is arranged inside the housing and emits the light.

13. The wall-mountable cooking apparatus as set forth in claim 12, further comprising transparent cover plates which cover the corresponding upper and lower openings and prevent foreign substances from entering into the housing.

14. The wall-mountable cooking apparatus as set forth in claim 13, wherein the cooking apparatus is a wall-mountable microwave oven.

15. The wall-mountable cooking apparatus as set forth in claim 14, further comprising a porous shield plate which covers the upper opening and allows the light emitted from the lighting device to pass therethrough while preventing high-frequency electromagnetic waves generated from the heating unit from passing therethrough.

16. A wall-mountable cooking apparatus having a cooking chamber and a single lighting device to directly and concurrently illuminate the cooking chamber and a kitchen space below the cooking apparatus via openings on an upper and a lower portions of the single lighting device.

17. The wall-mountable cooking apparatus of claim 16, wherein the single lighting device illuminates the cooking chamber and the kitchen space simultaneously.

18. The wall-mountable cooking apparatus as set forth in claim 11, wherein the lighting device concurrently illuminates the cooking chamber and the kitchen space below the oven body.

19. A wall-mountable cooking apparatus comprising:

an oven body which defines an outer appearance of the cooking apparatus, and includes a cooking chamber to receive food therein;

a heating unit which cooks the food;

a lighting device which is provided at a lower portion of the oven body;

a first bottom plate formed with an upper opening provided to the cooking chamber to allow the lighting device to illuminate the cooking chamber of the oven body formed with a lower opening; and a second bottom plate formed with a lower opening provided to the bottom portion of the oven body to allow the lighting device to directly illuminate the kitchen space below the oven body.

* * * * *

UNITED STATES PATENT AND TRADEMARK OFFICE

CERTIFICATE OF CORRECTION

PATENT NO. : 6,700,107 B2
DATED : March 2, 2004
INVENTOR(S) : Se-Hun Lee

It is certified that error appears in the above-identified patent and that said Letters Patent is hereby corrected as shown below:

Column 5,
Line 56, after "body" delete ","

Column 6,
Line 6, after "body" delete ","

Signed and Sealed this

First Day of June, 2004

JON W. DUDAS
*Acting Director of the United States Patent and Trademark Office*